US010960416B2

(12) United States Patent
Matlack et al.

(10) Patent No.: US 10,960,416 B2
(45) Date of Patent: Mar. 30, 2021

(54) FLUID INJECTION DEVICE AND METHOD OF MAKING THE SAME

(71) Applicant: Zynon Technologies, LLC, New Britain, CT (US)

(72) Inventors: Floyd Kent Matlack, North Granby, CT (US); Brian E. King, West Simsbury, CT (US); Adam Eckenroth, Terryville, CT (US)

(73) Assignee: ZYNON TECHNOOLOGIES, LLC, New Britain, CT (US)

( * ) Notice: Subject to any disclaimer, the term of this patent is extended or adjusted under 35 U.S.C. 154(b) by 28 days.

(21) Appl. No.: 16/226,851

(22) Filed: Dec. 20, 2018

(65) Prior Publication Data

US 2019/0193093 A1 Jun. 27, 2019

Related U.S. Application Data

(60) Provisional application No. 62/608,993, filed on Dec. 21, 2017.

(51) Int. Cl.
*F24F 1/26* (2011.01)
*B05B 1/30* (2006.01)
(Continued)

(52) U.S. Cl.
CPC ..... *B05B 1/3006* (2013.01); *F24F 1/26* (2013.01); *F24F 1/34* (2013.01); *F24F 11/36* (2018.01);
(Continued)

(58) Field of Classification Search
CPC ... B05B 1/3006; F24F 1/34; F24F 1/26; F24F 11/36; F25B 2345/006; F25B 45/00
See application file for complete search history.

(56) References Cited

U.S. PATENT DOCUMENTS 3,391,951 A 7/1968 Miller
3,424,181 A 1/1969 Morse
(Continued)

FOREIGN PATENT DOCUMENTS

EP 1637861 A1 3/2006
GB 1109899 A 4/1968

OTHER PUBLICATIONS

"Leak Saver Installation Method 3: One-Handed Installation" uploaded by LeakSavers Admin, Mar. 28, 2017 [retrieved on Feb. 6, 2019]. Retrieved from the Internet: https://www.youtube.com/watch?v=Avvw6b6-a9U&feature=youtu.be.
(Continued)

*Primary Examiner* — Nicolas A Arnett
(74) *Attorney, Agent, or Firm* — Cantor Colburn LLP

(57) ABSTRACT

A fluid injection device (10) for injecting a dispensible fluid material (28), e.g., a liquid sealant, into refrigerant lines of an operating air conditioning or refrigeration system or the like, includes a tube (12) having at its outlet end a fluid outlet valve (18) is closed by a valved plug (24) to provide therebetween an airlock chamber (42) containing a dried inert gas which prevents reaction, e.g., polymerization, of any liquid sealant which has leaked past the fluid outlet valve (18) prior to use of the device. The device (10) is used by removing the valve plug (24) just prior to use and connecting the outlet valve (18) to a low pressure zone of the system and then connecting an inlet closure member (14) to a high pressure zone of the system while the system is in operation. A method of making the device includes displacing air from the device with the inert gas and then introducing the material 18 into the tube.

22 Claims, 3 Drawing Sheets

(51) Int. Cl.
*F24F 1/34* (2011.01)
*F25B 45/00* (2006.01)
*F24F 11/36* (2018.01)

(52) U.S. Cl.
CPC ..... *F25B 45/00* (2013.01); *F25B 2345/006* (2013.01)

(56) References Cited

U.S. PATENT DOCUMENTS 3,550,817 A 12/1970 Babin
3,759,062 A 9/1973 Wrenn et al.
4,069,686 A 1/1978 Hoelman
4,745,772 A * 5/1988 Ferris ..... F25B 43/003 62/292
4,938,063 A * 7/1990 Leighley ..... G01M 3/20 73/40.7
5,070,917 A 12/1991 Ferris et al.
5,080,132 A 1/1992 Manz et al.
5,167,140 A * 12/1992 Cooper ..... G01M 3/20 73/40.7
5,582,202 A 12/1996 Schultz et al.
5,967,204 A 10/1999 Ferris et al.
5,975,151 A * 11/1999 Packo ..... F25B 45/00 141/18
6,056,162 A * 5/2000 Leighley ..... F16N 29/00 222/156
6,164,348 A * 12/2000 Rodwell ..... G01M 3/20 141/18
6,662,587 B2 12/2003 Rembold et al.
7,077,149 B2 7/2006 Kalley et al.
7,296,423 B2 * 11/2007 Appler ..... F25B 45/00 62/114
8,852,200 B2 10/2014 Steffen et al.
9,709,307 B2 7/2017 Carrubba et al.
10,632,816 B2 * 4/2020 Cai ..... F16L 29/02
10,655,742 B2 * 5/2020 Tourigny ..... F25B 45/00
2002/0189265 A1 * 12/2002 Ferris ..... C09K 3/12 62/77
2004/0124289 A1 7/2004 Yamamoto et al.
2004/0168463 A1 * 9/2004 Dudley ..... F25B 45/00 62/292
2005/0061014 A1 * 3/2005 Cannan ..... B60H 1/00585 62/292
2005/0081914 A1 4/2005 Kalley et al.
2008/0196789 A1 8/2008 Hartl
2011/0041522 A1 2/2011 Carrubba
2013/0118187 A1 5/2013 Carrubba
2016/0178107 A1 6/2016 Cacciabeve et al.
2016/0290694 A1 10/2016 Pearl et al.
2016/0290695 A1 10/2016 Bi et al.
2018/0029318 A1 2/2018 Franklin

OTHER PUBLICATIONS

International Search Report for International Application No. PCT/US18/66694; International Filing Date Dec. 20, 2018; dated Feb. 22, 2019; 4 pages.
Nu-Calgon Product Bulletin, 3-52, A/C EasySeal, 4 pages.
Vibralign Blog, Long Live the Machine, "Mechanical Seal Basics," by Mac MacCormack on Sep. 17, 2014, 11 pages.
Written Opinion for International Application No. PCT/US18/66694; International Filing Date Dec. 20, 2018; dated Feb. 22, 2019; 18 pages.

* cited by examiner

FLUID INJECTION DEVICE AND METHOD OF MAKING THE SAME

CROSS-REFERENCE TO RELATED APPLICATION

This application claims priority of provisional patent application Ser. No. 62/608,993 filed on Dec. 21, 2017 in the name of Floyd Kent Matlack et al., and entitled "Fluid Injection Device and Method of Making and Using the Same".

BACKGROUND OF THE INVENTION

Field of the Invention

The present invention concerns a fluid injection device for injecting a fluid, such as a sealant liquid, into a system, such as an air conditioning or refrigeration system, and methods of making and using the injection device.

Description of Related Art

Devices for the injection of a dispensible fluid, such as a liquid sealant, into air conditioning and refrigeration systems are known in the art. Such devices comprise a tube containing a fluid to be dispensed from the tube via a fluid outlet valve in the tube. For example, Cacciabeve et al. Published Patent Application US 2016/0178107 A1 ("Cacciabeve"), entitled "Sealant Hose and Method of Use", was published on Jun. 23, 2016. A hose 12 contains fluid sealant and is shown in FIG. 2 of Cacciabeve in an exploded view. As shown in FIG. 1, hose 12 has its inlet end connected by a refrigerant service hose (unnumbered) to an air conditioning manifold gauge 6 and its outlet end connected to the service port (SP) of an air conditioning system (AC). FIG. 3 shows an inlet valve 14 which connects the inlet end of the tube 12 to the refrigerant service hose and FIG. 4 shows an outlet valve 16 which is connected to the outlet end of the tube 12. Outlet valve 16 is seen to comprise a first housing 54 and a second housing 56 and is configured to be opened when attached to the air conditioning service port by a tapered member (not shown in the drawings) of the service port. Connection of the outlet valve 16 to the service port opens the valve so that the pressure from the air conditioning manifold gauge 6 dispenses the fluid sealant through outlet valve 16.

A significant problem encountered by prior art fluid injection devices such as that of Cacciabeve is leakage of the sealant past the fluid outlet valve prior to use, for example, during manufacture, storage and/or shipment. Such leakage may occur because of failure of the valve components to fully seat against each other, or by vibration during shipment, etc. Experience has shown that contact with moisture, e.g., atmospheric humidity, by even very slight leakage past the outlet valve of, for example, a ternary silane liquid sealant, will effectively glue the outlet valve components together, rendering the injection device useless. An unacceptably high degree of failure of injection devices utilizing such prior art valves at the outlet end of the device has been reported. Considerable expense is incurred by the too-frequent return and reworking of injection devices which are rendered inoperative because of leaked sealant, to say nothing of significant customer dissatisfaction.

The present invention overcomes the foregoing leakage problem by providing at the outlet end of the tube an airlock chamber containing an inert gas, which may be a dried inert gas. Any leaked sealant is exposed only to the inert gas during manufacture, storage, shipping and handling, and polymerization or other contamination of leaked sealant is thereby avoided.

SUMMARY OF THE INVENTION

Generally, the present invention provides a fluid injection device for injecting via a fluid outlet valve a dispensible fluid material, such as a sealant liquid or other liquid, into a closed pressurized system such as an operating air conditioning or operating refrigeration system, or the like system, while the system is operating. (For economy of expression, in the following discussion reference is sometimes made to a sealant or a sealant liquid, although the present invention encompasses devices for injecting other types of dispensible fluid material.) The fluid injection devices of the present invention overcome the above-described problem of pre-use leakage of dispensible fluid material past the fluid outlet valve of the device. This is attained by providing downstream of the fluid outlet valve an "airlock" chamber containing an "inert gas" (as defined below), e.g., a dry inert gas, so that any dispensible fluid material which leaks past the fluid outlet valve is exposed only to the inert gas in the airlock chamber and is thereby protected from contact with the ambient atmosphere. If protection of the dispensible fluid material from moisture is required, the inert gas is dried prior to being introduced into the airlock chamber. The valved plug may be readily removable from the device by the user just prior to use and the dispensible fluid material is discharged through the fluid outlet valve in the conventional manner. Alternatively, the valved plug may be affixed to the device so that it is not readily or at all removable by the user. In such case, the valved plug is configured to be connected in flow communication to the system in which the dispensible fluid material is to be injected. In such case, the dispensible fluid material is discharged through the airlock chamber, and the small amount of inert gas in the airlock chamber is introduced into the system together with the dispensible fluid material.

Specifically, in accordance with the present invention there is provided a fluid injection device for injecting a dispensible fluid material into a pressurized system having therein relatively high and low pressure zones of a pressurized fluid, the fluid injection device comprising the following components. A tube has an inlet end and an outlet end, the inlet end having thereon an inlet closure member which is connectible in fluid flow communication to such high pressure zone, and the outlet end having thereon an outlet fixture which is connectible in fluid flow communication with such low pressure zone. This connectability enables connection of the injection device to such pressurized system. The tube defines therewithin a closed storage chamber disposed between the inlet closure member and the outlet fixture, and a dispensible fluid material is disposed within the closed storage chamber. The outlet fixture comprises an airlock disposed downstream of the outlet valve and containing a gas which is inert to the dispensible fluid material. In this way, any dispensible fluid material which, prior to use, leaks from the closed storage chamber towards the outlet fixture is exposed only to the gas contained in the airlock.

Other aspects of the present invention provide one or more of the following additional features, alone or in any suitable combination. The outlet fixture may comprise an outlet valve disposed at the outlet end of the tube and a valved plug disposed downstream of the outlet valve, the outlet valve and the valved plug cooperating to form the airlock between them; the valved plug may be configured to be readily removable from the device by a user, so that the outlet valve may be directly connected to the pressurized system; the valved plug may be configured to be directly connected in fluid flow communication to the pressurized system; the outlet fixture may be configured to automatically, upon being connected to such low pressure zone, switch from a closed position to an open position, and the inlet closure member may be configured to automatically, upon being connected to such high pressure zone, switch from a closed position to an open position to permit passage therethrough of such pressurized fluid from such high pressure zone into the device, to dispense the dispensible fluid material through the outlet fixture into such low pressure zone; the inlet closure member, the outlet fixture and the valved plug may each comprises a Schrader valve; the inert gas may be at a pressure of from about 35 to about 65 PSIA, e.g., from about 45 to about 55, PSIA; and the dispensible fluid material may be a sealant liquid suitable for sealing leaks in a closed system; the inert gas may be nitrogen or any suitable gas which is chemically inert to the dispensible fluid material; the inert gas may be a dried gas whose moisture content is eliminated or so low as to be incapable of initiating a polymerization or other reaction with the dispensible fluid material; the tube may be a moisture-impermeable tube; and the valved plug may be made of a moisture-impermeable material.

Still other aspects of the present invention provide one or more of the following additional features, alone or in any suitable combination. The outlet valve may comprise a valve seal which is movable from a closed position which closes the outlet valve to an open position which opens the outlet valve, and a spring which has a spring force and is disposed to urge the valve seal into its closed position by imposing the spring force on the valve seal, and the airlock chamber may be disposed so that the pressure of the inert gas contained therein urges the valve seal into its closed position, and the pressure of the inert gas may be greater than the spring force; the spring force may be from about 25 to about 35 PSIA and the pressure of the inert gas may be from about 45 to 55 PSIA; the dispensible fluid material may be a sealant fluid suitable for sealing leaks in a closed system; and the tube and at least those portions of the inlet closure member and the outlet fixture which are susceptible to contact with the dispensible fluid material may be comprised of a moisture-impermeable material.

Yet another aspect of the present invention provides for a fluid injection device for injecting a dispensible fluid material into a pressurized system having relatively high and low pressure zones of a pressurized fluid, the fluid injection device comprising the following components. A tube made of a moisture-impermeable material has an inlet end and an outlet end, the inlet end having thereon an inlet closure member which is connectible in fluid flow communication to such high pressure zone, and the outlet end having thereon an outlet fixture which is connectible in fluid flow communication with such low pressure zone, to thereby enable connection of the injection device to such pressurized system. The outlet fixture further has an outlet valve disposed at the outlet end of the tube and a valved plug disposed downstream of the outlet valve, the outlet valve and the valved plug cooperating to form an airlock between them. The airlock contains an inert gas and the valved plug is configured to be readily removable from the device by a user, so that the outlet valve may be directly connected to such pressurized system. The tube defines therewithin a closed storage chamber disposed between the inlet closure member and the outlet fixture and a dispensible fluid material is disposed within the closed storage chamber. Removal of the valved plug from the device exposes the outlet valve to enable connection of the outlet valve directly to such low pressure zone. The outlet valve is configured to be connected to such low pressure zone, and to open only when high pressure imposed from the inlet end of the tube pushes the outlet valve open. The inlet closure member is configured to automatically, upon being connected to such high pressure zone, switch from a closed position to an open position to permit passage through the outlet valve of such pressurized fluid from such high pressure zone into the device so as to dispense the dispensible fluid material through the outlet valve into such low pressure zones.

Other aspects of the invention provide for one or more of the following additional features alone or in any suitable combination. The inlet closure member and the valved plug may each comprise a Schrader valve and the outlet valve may comprise a one-way check valve that permits flow only outwardly of the device; and the dispensible fluid material may comprise a liquid sealant suitable for sealing leaks in such pressurized system.

A method aspect of the present invention comprises a method for making a fluid injection device, the device comprising a tube having an inlet end and an outlet end, the method comprising the following steps. Securing to the outlet end an outlet fixture comprising an outlet valve and a valved plug secured to the outlet valve. The valved plug may optionally be removably secured to the outlet valve so as to be readily removable from the outlet valve by a user. The outlet fixture further comprises an airlock disposed between the outlet valve and the valved plug. Opening the outlet fixture to passage of a gas therethrough and injecting an inert gas into the inlet end and through the tube and the outlet fixture to displace ambient air from the device. Closing the outlet fixture to passage of a gas therethrough and inserting into the tube from the inlet end thereof a dispensible fluid material to displace the inert gas from the tube but not from the outlet fixture. After completing introduction of the dispensible fluid material into the tube, sealing the inlet end of the tube containing the inserted dispensible fluid material by closing the inlet end with an inlet closure member.

Another method aspect of the present invention further includes securing to the inlet end an inlet closure member configured to receive therein a Schrader valve in a valve passage extending through the inlet closure member, and injecting the inert gas and then inserting the dispensible fluid material through the valve passage, after which the Schrader valve is inserted into the valved passage.

Other method aspects of the present invention comprise one or more of the following additional steps in any suitable combination. Initially introducing the dispensible fluid material into the tube at or adjacent to the outlet fixture whereby the dispensible fluid material level increases towards the inlet end as more material is introduced into the tube; the inlet closure member and the valved plug each comprises respective Schrader valves and the outlet valve may comprise a one-way check valve that permits flow only outwardly of the device; and securing the inlet closure member to the inlet end of the tube, e.g., with a ferrule, and securing the outlet fixture to the outlet end of the tube, e.g., with a ferrule.

As used herein and in the claims, the following terms have the indicated meanings. The term "dispensible fluid material" means dispensible liquids, pastes, gels and the like including, without limitation, liquid polymers, liquid polymer precursors, liquids with fine particulate solids suspended therein, colloidal suspensions, gels, and in general, flowable non-gaseous materials, and mixtures of two or more thereof. The term "inert gas" does not necessarily mean the chemical definition of inert gases, although the term may include classical inert gases, but means a gas which is inert to the dispensible fluid material. By "inert" in this context is meant a gas which will not adversely affect the dispensible fluid material such as by causing it to polymerize or otherwise be adversely affected. A "downstream" or "upstream" location or structure indicates a location or structure as sensed relative to the direction of dispensible fluid material being discharged from the device. A "dry" inert gas is one from which moisture has been eliminated or sufficiently reduced so that dispensible fluid material which is adversely affected by moisture is not adversely affected by contact with the dry inert gas during manufacture, shipping and storage. Reference to an "operating" system means a system which is in operation and therefore has high and low pressure zones.

DETAILED DESCRIPTION OF THE INVENTION AND SPECIFIC EMBODIMENTS THEREOF

Figure 1:
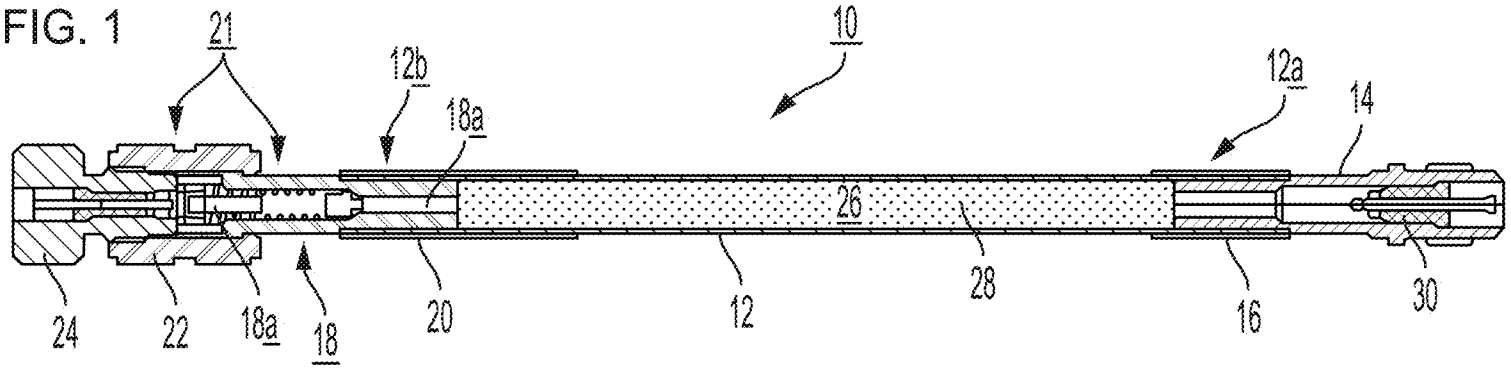
FIG. 1 is a view in elevation of one embodiment of the injection device of the present invention.

Referring now to FIG. 1, there is shown a fluid injection device 10 comprised of a tube 12 having an inlet end 12*a* and an opposite outlet end 12*b*. Tube 12 is configured to define therein a storage chamber 26 within which a dispensible fluid material 28 is contained. Inlet end 12*a* has an inlet closure member 14 secured thereto by a first ferrule 16. Inlet closure member 14 may be made of any suitable material, metal, e.g., steel, plastic or other material and includes a suitable conventional valve, such as a Schrader valve 30 mounted in a valve passage (unnumbered) extending through inlet closure member 14. Outlet end 12*b* has thereon an outlet fixture 21 comprised of a fluid outlet valve 18 which is secured to tube 12 by a second ferrule 20, a threaded outlet collar 22 mounted on outlet valve 18, and a valved plug 24 threaded onto outlet collar 22. Outlet collar 22 is internally threaded or otherwise configured both to engage valved plug 24 and, upon removal of valved plug 24, to attach outlet collar 22 to a service port located in the low pressure zone refrigerant line of an air conditioning or other closed system, as described below. Valved plug 24 is threaded or otherwise configured to be engaged by outlet collar 22 to position the valved plug 24 adjacent to outlet valve 18.

Tube 12 is preferably comprised of a moisture-impermeable material and may be transparent or translucent, or may at least have a transparent or translucent section, to enable a user to see the dispensible fluid material 28 contained within storage chamber 26, and to observe the transport of such dispensible fluid material through tube 12 for discharge from the outlet valve 18. Tube 12 may, for example, be a polyvinyldifluoride such as that sold under the trademark Kynar by Arkema, Inc., or it may be any other suitable material.

The moisture impermeability of tube 12 enables the tube to be used with dispensible fluid materials which are highly reactive with water. For example, one suitable and commercially available dispensible fluid material is a liquid sealant which comprises a ternary silane which is highly reactive with moisture. Such ternary silane sealant, when in contact with moisture, will within a few hours polymerize to form a solid. It is therefore important to maintain such dispensible liquid sealants isolated from contact with moisture until the sealant liquid is dispensed into the air conditioning or refrigeration closed system to fill any leaks such as pin-point openings in the system refrigerant lines. As noted above, pre-use polymerization of leaked sealant can render the fluid injection device useless. As the sealant liquid is dispersed throughout the closed system refrigerant lines, any such openings are contacted by the sealant, which plugs the leaks by reacting with moisture, such as atmospheric humidity or water condensate present at the exteriors of the pin-point openings, to polymerize and seal the site or sites of the leaks.

Figure 2:
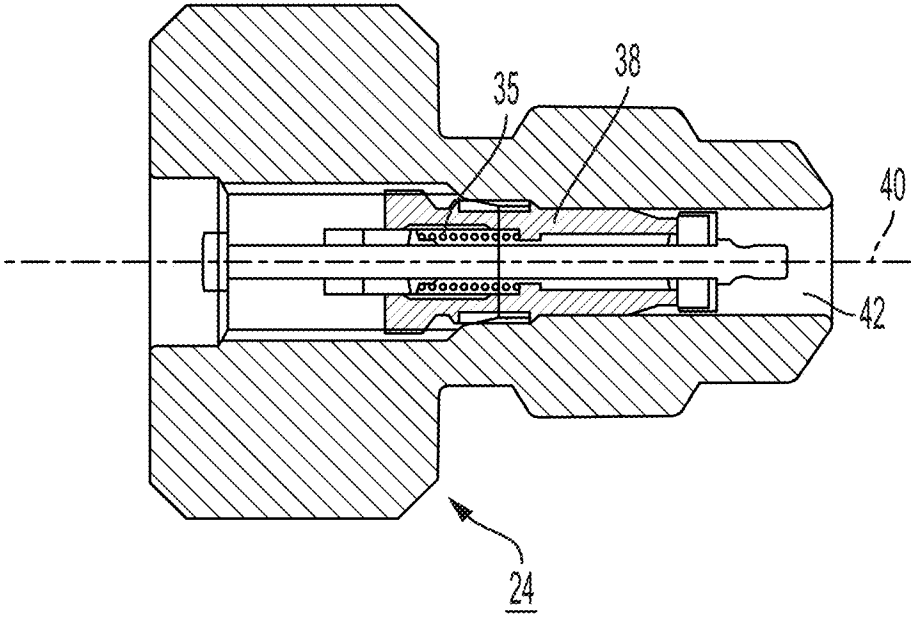
FIG. 2 is a cross-sectional view in elevation, enlarged relative to FIG. 1, of an embodiment of the valved plug component of the device of FIG. 1.

Referring to FIG. 2, valved plug 24 (and outlet collar 22) is made of metal, e.g., steel, plastic or other material that is hydrophobic and creates a reliable moisture barrier. The valved plug 24 is equipped with a check valve, or a one-way Schrader valve (or similar valve) 38 that allows gas or liquid flow through it when opened, but prevents gas or liquid flow through it when closed. Valve 38 comprises a coil spring 35 and an actuator pin 40. An airlock chamber 42 is defined at the upstream end of valved plug 24.

Figure 3A:
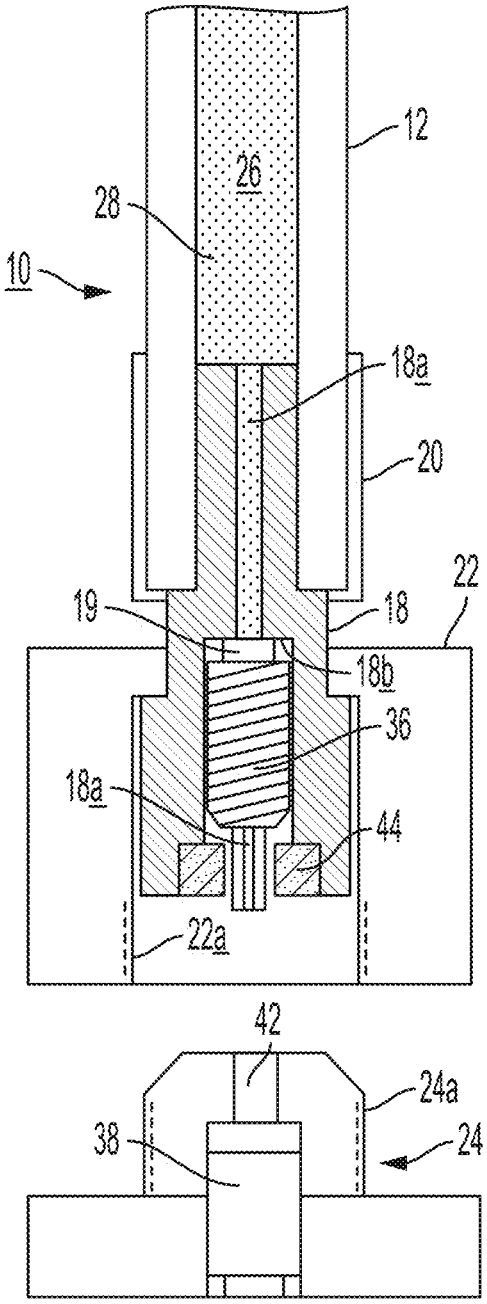
FIG. 3A is a cross-sectional schematic partial view in elevation showing the valved plug aligned with the fluid injection device.
Figure 3B:
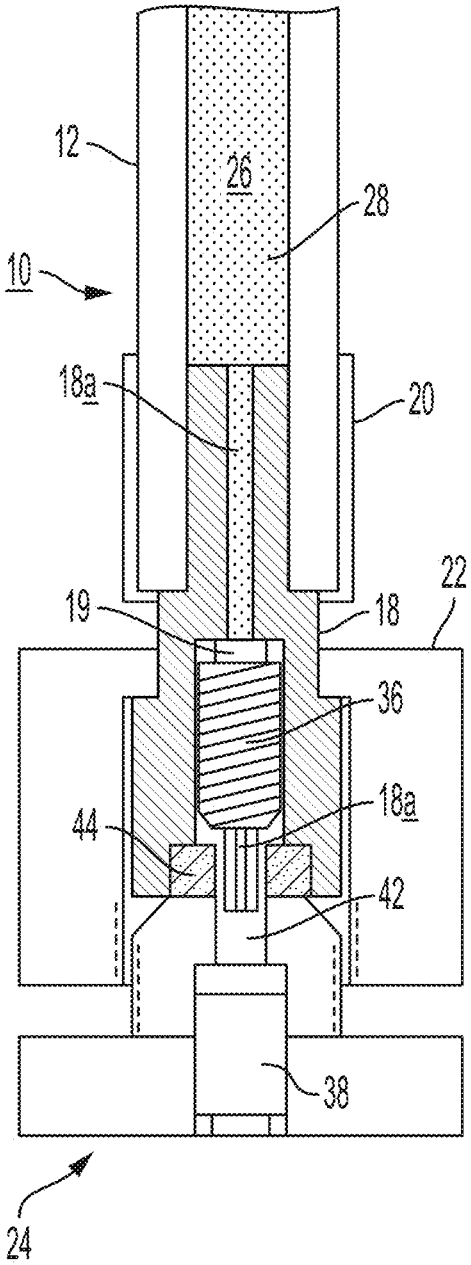
FIG. 3B is a view corresponding to FIG. 3A but showing the valved plug installed in the fluid injection device.

FIG. 3A shows valved plug 24 aligned with outlet collar 22 preparatory to screwing valved plug 24 into collar 22 by engaging external threads 24*a* (FIG. 3A) of valved plug 24 with internal threads 22*a* (FIG. 3A) of outlet collar 22. As shown in FIG. 3B, valved plug 24, when tightly threadably engaged with outlet collar 22, is seated against a fluid outlet valve sealing gasket 44 that is at the base of outlet valve 18. Airlock chamber 42 is aligned with the outlet passage 18*a* and contains a gas, such as dry nitrogen gas, that is inert relative to the dispensible fluid material 28 contained within storage chamber 26. The inert (to material 28) gas also fills the portion of outlet valve 18 on the downstream side of outlet valve seal 19. The firm seating of valved plug 24 against valve sealing gasket 44 creates an air-tight seal that prevents air (and moisture) from coming in contact with any sealant 28 that may have leaked around the outlet valve seal 19. Valve 18 has an outlet passage 18*a* which extends through the length of outlet valve 18 to provide a flow path between the dispensible fluid material 28 within storage chamber 26 and airlock chamber 42. A shoulder 18*b* is formed in the body of outlet valve 18. The flow path through outlet passage 18*a* is blocked when outlet valve seal 19 is in the position shown in FIGS. 3A and 3B, i.e., firmly seated against shoulder 18*b*. Coil spring 36 is contained in a chamber (unnumbered) of outlet valve 18 which is of larger diameter than passage 18*a* with which the unnumbered chamber is in flow communication when outlet valve seal 19 is displaced downwardly as viewed in FIGS. 3A and 3B, i.e., when displaced in the direction towards valved plug 24.

Figure 4A:
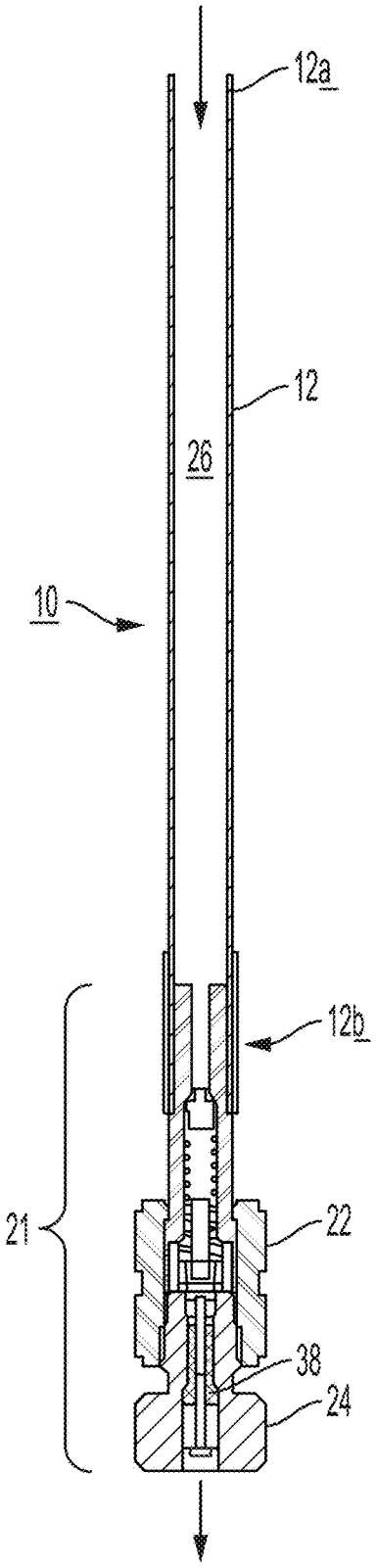
FIGS. 4A and 4B show steps in the manufacture of the injection device in accordance with a method embodiment of the present invention.
Figure 4B:
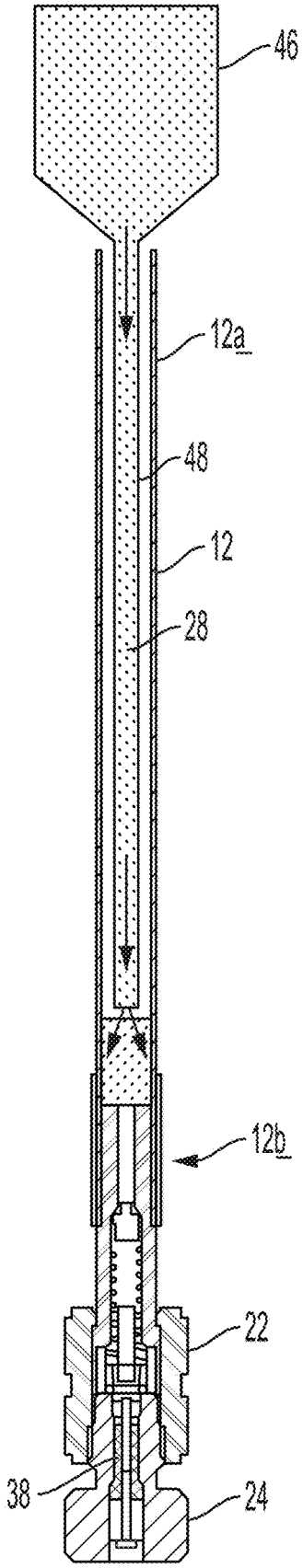

The filling of the device 10, that is, the introduction into fluid injection device 10 of the inert (to material 28) gas and the filling of storage chamber 26 with dispensible fluid material 28, e.g., a suitable liquid sealant, is schematically illustrated in FIGS. 4A and 4B. As shown in FIG. 4A, outlet fixture 21 is mounted onto the outlet end 12*b* of tube 12, but inlet closure member 14 (FIG. 1) has not yet been mounted on inlet end 12*a*. A blanket of dry inert gas (nitrogen or a similar inert gas) is injected into the empty tube 12 from the inlet end 12*a* thereof as shown by the unnumbered arrows in FIG. 4A. The injected gas serves to displace ambient air (and moisture) from the tube 12, via outlet fixture 21 through outlet valve 18 and valved plug 24, replacing air with the inert gas in outlet fixture 21, including in the airlock chamber 42. The valve 38 of valved plug 24 is held open by a means (not shown) to permit the flowing inert gas to exit valved plug 24. After the inert gas is introduced to all internal areas of the tube assembly (tube 12 and the components of outlet fixture 21), valve 38 is closed and the tube 12 is then filled with sealant 28 as shown in FIG. 4B. Sealant 28 is introduced via inert end 12*a* into the assembly of the device 10 without inlet closure member 14 in place, but with outlet fixture 21 (which includes valved plug 24) in place on tube 12. The sealant 28 is introduced from a sealant reservoir 46 via a fill tube 48 into the storage chamber 26 (FIG. 4A). Storage chamber 26 is filled from the bottom up as viewed in FIG. 4B, that is, from outlet end 12*b* towards inlet end 12*a*. The sealant 28 displaces nitrogen in the wetted areas of the tube 12, that is, in the portion of tube 12 containing the dispensible fluid material 28, i.e., storage chamber 26. The inlet end 12*a* of tube 12 is then closed by inlet closure member 14 to create a fully air-tight seal, and the assembly of device 10 is complete.

Another method of filling fluid injection device 10 is to commence with a device 10 which, except that Schrader valve 30 is omitted from inlet closure member 14, is fully assembled. Purging device 10 with the inlet gas and then filling with the dispensible fluid material is carried out as described in the immediately preceding paragraph. The fill tube 48 is inserted via the opening provided in inlet closure member 14 by the valve passage extending therethrough. After the inert gas purge and insertion of the dispensible fluid material is complete, and fill tube 48 is fully withdrawn from device 10, Schrader valve 30 is inserted into the valve passage of inlet closure member 14, to complete the assembly of device 10.

The resulting structure of device 10 is such that even if the fluid outlet valve 18 leaks sealant prior to use, that is, during manufacture, storage or shipping, the leaked sealant is not polymerized or contaminated because all internal areas of outlet fixture 21, including airlock chamber 42, are filled with dry inert gas which is held captive by the valved plug 24 and the check valve sealing gasket 44 and by the outlet valve 18, which may be a Schrader valve. Any sealant which has leaked past outlet valve 18 prior to use of device 10 therefore has no water with which to react, and so it does not polymerize, and does not glue the outlet valve 18 in the closed position.

Just prior to use, the valved plug 24 is removed by unscrewing it from the outlet collar 22, as shown in FIG. 3A. (FIG. 3A serves to illustrate the position of valved plug 24 both prior to connection to threaded collar 22, as described above, and after removal of valved plug 24 from threaded collar 22 at the time of use of the device 10.) Removal of valved plug 24 by the user allows the user to thread the outlet collar 22 of the fluid injection device 10 onto the Schrader service port (not illustrated) of the closed system being serviced, e.g., an HVAC (heating, ventilation, air conditioning) system, to introduce the sealant 28 into the system refrigerant lines. Typically, service ports and manifold connector ports of pressurized closed systems include a structure which contacts the respective operating pins of the valves (outlet valve 18 and the valve 30 of the inlet closure member 14 of the illustrated embodiment) to automatically open those valves upon connection of the device 10 to the pressurized system. Typically, the service ports and manifold connector ports comprise Schrader valves or the like to also open the system ports upon the connections being made.

It is useful, but not necessary to the practice of the present invention, to pressurize the nitrogen or other inert gas that is trapped in the internal area between the valved plug 24 and the outlet valve 18, that is, in airlock chamber 42, to a suitable pressure, e.g., a pressure of from about 35 to about 65 PSIA, e.g., a pressure of about 45 to 55 PSIA, e.g., about 50 PSIA. As this pressure is higher than the force imposed on seal 19 by coil spring 36, the inert gas puts added pressure on outlet valve seal 19 from the back side (the side of seal 19 facing coil spring 36). The pressurized inert gas thus forces outlet valve seal 19 against shoulder 18*b* causing seal 19 to make a tighter seal, and therefore making it more difficult for the sealant 28 to leak around the seal 19. The advantage of this is that if the outlet valve seal 19 is maintained in place solely by the pressure imposed by coil spring 36 there is a limit as to how much force the coil spring 36 should exert. It is advantageous that coil spring 36 allows the outlet valve seal 19 to open at a pressure of from about 25 to 35 PSIA, e.g., at about 30 PSIA, to allow sealant 28 to flow into the system being treated. This means that the spring force exerted by the coil spring 36 should exert only limited force on the outlet valve seal 19, which makes it easier for sealant 28 to leak around the outlet valve seal 19. The use of nitrogen at, for example, 50 PSIA pressure allows for a higher force to be imposed against the back side of the outlet valve seal 19 to improve the seal. The 50 PSIA pressure is relieved when the valved plug 24 is removed prior to use so that in use, the sealant or other dispensible fluid material 28 need overcome only the lower pressure imposed by the coil spring 36 in order to be discharged from device 10. The use of 50 PSIA dry nitrogen allows the continued use of a 30 PSIA spring force, with the nitrogen imposing a higher pressure on seal 19 to eliminate or reduce leakage.

In use, inlet closure member 14 is secured to a high pressure zone of a system being treated, for example, to a manifold outlet port, and by means of a suitable refrigeration service hose if, as is often the case, device 10 is not long enough to connect the manifold outlet port to a service port at a low pressure zone of the pressurized system being treated. Outlet valve 18 is secured to a service port at a relatively low pressure end of the air conditioning or refrigeration closed system being treated, by means of threaded outlet collar 22. A spring (not shown) of the Schrader valve 30 is depressed upon connection to the discharge port by a tang (not shown) in the discharge port, as is well known in the art A conventional valve on the manifold is opened so that the refrigerant in the high pressure zone acts on the Schrader valve 30 contained within inlet closure member 14, to open the valve 30. Pressure generated by the refrigerant in the high pressure zone forces the dispensible fluid material 28, e.g., a liquid sealant, out of storage chamber 26, through Schrader valve 30 and storage chamber 26, thence through outlet valve 18, into a low pressure zone of the closed system. When the liquid sealant has been discharged, the valve on the manifold may be closed and the device disconnected from the system. Alternatively, valved plug 24 may be configured to connect to a system service port with the dispensible sealant discharged through outlet valve 18 and valved plug 24.

Tube 12 is conveniently designed to withstand the highest pressure to which it will be subjected when attached to the refrigerant lines of any standard air conditioning, refrigeration or the like system. Alternatively, tube 12 may be provided in different strengths to withstand, without bursting, the highest pressure which will be encountered in a given type of system. Preferably, tube 12 is made with sufficient bursting strength to resist the highest pressure it will encounter in any standard air conditioning, refrigeration or the like system so that only a single part need be kept in inventory.

While the invention has been described in detail with reference to specific embodiments, it will be appreciated that numerous variations may be made to the described embodiment, which variations nonetheless lie within the scope of the present invention.

What is claimed is:

1. A fluid injection device for injecting a dispensible fluid material into a pressurized system having therein relatively high and low pressure zones of a pressurized fluid, the fluid injection device comprising:

a tube having an inlet end and an outlet end, the inlet end having thereon an inlet closure member which is connectible in fluid flow communication to such high pressure zone, and the outlet end having thereon an outlet fixture which comprises an outlet valve and a valved plug disposed downstream of the outlet valve, the outlet valve and the valved plug cooperating to form between them an airlock chamber, the outlet valve being connectible in fluid flow communication with such low pressure zone, to thereby enable connection of the injection device to such pressurized system;

the tube defining therewithin a closed storage chamber disposed between the inlet closure member and the outlet fixture;

a dispensible fluid material disposed within the closed storage chamber; and airlock chamber containing a gas which is inert to the dispensible fluid material;

whereby any dispensible fluid material which, prior to use, leaks from the closed storage chamber towards the outlet fixture is exposed only to the gas contained in the airlock chamber.

2. The device of claim 1 wherein the valved plug is configured to be readily removable from the device by a user, whereby the outlet valve may be directly connected to the pressurized system.

3. The device of claim 1 wherein the valved plug is configured to be directly connected in fluid flow communication to the pressurized system.

4. The device of claim 1 wherein the outlet fixture is configured to automatically, upon being connected to such low pressure zone, switch from a closed position to an open position, and the inlet closure member is configured to automatically, upon being connected to such high pressure zone, switch from a closed position to an open position to permit passage therethrough of such pressurized fluid from such high pressure zone into the device to dispense the dispensible fluid material through the outlet fixture into such low pressure zone.

5. The device of claim 1 wherein the inlet closure member, the outlet fixture and the valved plug each comprises a Schrader valve.

6. The device of claim 1 wherein the inert gas is at a pressure of from about 35 to about 65 PSIA.

7. The device of claim 6 wherein the inert gas is at a pressure of from about 45 to 55 PSIA.

8. The device of claim 6 wherein the inert gas is chemically inert to the dispensible fluid material.

9. The device of claim 8 wherein the inert gas comprises a dried gas whose moisture content is eliminated or so low as to be incapable of initiating a polymerization or other reaction with the dispensible fluid material.

10. The device of claim 1 wherein the outlet valve comprises a valve seal which is movable from a closed position which closes the outlet valve to an open position which opens the outlet valve, and a spring which has a spring force and is disposed to urge the valve seal into its closed position by imposing the spring force on the valve seal, and the airlock chamber is disposed so that the pressure of the inert gas contained therein urges the valve seal into its closed position, and the pressure of the inert gas is greater than the spring force.

11. The device of claim 10 wherein the spring force is from about 25 to about 35 PSIA and the pressure of the inert gas is from about 45 to 55 PSIA.

12. The device of claim 1 wherein the dispensible fluid material is a sealant fluid suitable for sealing leaks in a closed system.

13. The device of claim 1 wherein the tube and at least those portions of the inlet closure member and the outlet fixture which are susceptible to contact with the dispensible fluid material are comprised of a moisture-impermeable material.

14. A fluid injection device for injecting a dispensible fluid material into a pressurized system having relatively high and low pressure zones of a pressurized fluid, the fluid injection device comprising:

a tube made of a moisture-impermeable material and having an inlet end and an outlet end, the inlet end having thereon an inlet closure member which is connectible in fluid flow communication to such high pressure zone, and the outlet end having thereon an outlet fixture which is connectible in fluid flow communication with such low pressure zone, to thereby enable connection of the injection device to such pressurized system;

the outlet fixture further comprising an outlet valve disposed at the outlet end of the tube and a valved plug disposed downstream of the outlet valve, the outlet valve and the valved plug cooperating to form an airlock between them and the airlock containing an inert gas;

the valved plug being configured to be readily removable from the device by a user, whereby the outlet valve may be directly connected to such pressurized system;

the tube defining therewithin a closed storage chamber disposed between the inlet closure member and the outlet fixture;

a dispensible fluid material disposed within the closed storage chamber;

wherein removal of the valved plug from the device exposes the outlet valve to enable connection of the outlet valve to such low pressure zone, the outlet valve being configured to be connected to such low pressure zone, and the inlet closure member being configured to automatically, upon being connected to such high pressure zone, switch from a closed position to an open position to permit passage therethrough of such pressurized fluid from such high pressure zone into the device to dispense the dispensible fluid material through the outlet valve into such low pressure zones.

15. The device of claim 14 wherein the inlet closure member and the valved plug each comprises a Schrader valve and the outlet valve comprises a one-way check valve that permits flow only outwardly from the device.

16. The device of claim 14 or claim 15 wherein the dispensible fluid material comprises a liquid sealant suitable for sealing leaks in such pressurized system.

17. The device of claim 14 or claim 15 wherein the inert gas is at a pressure of from about 45 to 55 PSIA.

18. A method of making a fluid injection device, the device comprising a tube having an inlet end and an outlet end, the method comprising the steps of:

securing to the outlet end an outlet fixture comprising an outlet valve and a valved plug secured to the outlet valve, the outlet fixture further comprising an airlock disposed between the outlet valve and the valved plug;

opening the outlet fixture to passage of a gas therethrough and injecting an inert gas into the inlet end and through the tube and the outlet fixture to displace ambient air from the device;

closing the outlet fixture to passage of a gas therethrough and inserting into the tube from the inlet end thereof a dispensible fluid material to displace the inert gas from the tube but not from the outlet fixture; and after introduction of the dispensible fluid material into the tube is completed, sealing the inlet end of the tube containing the inserted dispensible fluid material by closing the inlet end with an inlet closure member.

19. The method of claim 18 wherein further comprising removably securing the valved plug to the outlet valve whereby the valved plug is readily removable from the outlet valve by the user.

20. The method of claim 18 or claim 19 further comprising initially introducing the dispensible fluid material into the tube at or adjacent to the outlet fixture whereby the dispensible fluid material level increases towards the inlet end as more material is introduced into the tube.

21. The method of claim 18 or claim 19 wherein the inlet closure member, the outlet valve and the valved plug each comprises respective Schrader valves, and the outlet valve comprises a one-way check valve that permits flow only outwardly from the device.

22. The method of claim 18 or claim 19 including securing to the inlet end an inlet closure member configured to receive therein a Schrader valve in a valve passage extending through the inlet closure member, and injecting the inert gas and then inserting the dispensible fluid material through the valve passage, after which the Schrader valve is inserted into the valved passage.

* * * * *